US005961303A

United States Patent [19]

King

[11] Patent Number: 5,961,303

[45] Date of Patent: Oct. 5, 1999

[54] POSITIVE DISPLACEMENT DISPENSING PUMP SYSTEM

[76] Inventor: Kenyon M. King, 8739 Lion St., Rancho Cucamonga, Calif. 91730

[21] Appl. No.: 08/972,334

[22] Filed: Nov. 18, 1997

[51] Int. Cl.[6] ..... F04B 7/06

[52] U.S. Cl. ..... 417/492; 417/53

[58] Field of Search ..... 417/500, 53, 492, 417/205, 517, 519, 385, 248, 246, 419, 518, 388; 99/450.7

[56] References Cited

U.S. PATENT DOCUMENTS

| | | | |
|---|---|---|---|
| 1,099,155 | 6/1914 | Ahlborn | 417/492 |
| 3,168,872 | 2/1965 | Pinkerton | 417/492 |
| 3,631,818 | 1/1972 | Zito | 99/450.7 |
| 4,008,003 | 2/1977 | Pinkerton | 417/250 |
| 4,479,758 | 10/1984 | Herson et al. | 417/338 |
| 4,599,049 | 7/1986 | Gordon et al. | 417/519 |
| 4,941,809 | 7/1990 | Pinkerton | 417/500 |
| 5,015,157 | 5/1991 | Pinkerton | 417/500 |
| 5,482,448 | 1/1996 | Atwater et al. | 417/492 |

FOREIGN PATENT DOCUMENTS

| | | | |
|---|---|---|---|
| 215740 | 3/1939 | Switzerland | 417/492 |

*Primary Examiner*—Charles G. Freay
*Assistant Examiner*—Robert Z. Evora
*Attorney, Agent, or Firm*—Leo R. Carroll

[57] ABSTRACT

This disclosure describes a pump that dispenses controlled amounts of flowable material by computer controlling both the displacement and angular position of the piston with servomechanism means. The system includes container means to hold a supply of flowable product material to be dispensed; cylindrical piston and piston housing means having a plurality of inlet porting means adapted to receive said flowable product material from the container means, and a plurality output porting means adapted to dispense said product from said container; piston rod means connected to the piston means so as to impart linear and rotary motion to said piston means. Rotary and linear drive means are connected to the piston rod means and adapted to alternately cause surface apertures to align with the inlet porting means while causing surface lands to restrict flow from the outlet porting means, then cyclically reversing said process. A computer controls all aspects of the dispensing pump, including rate and volume of the recharge and discharge cycle, timing, opening size and rate of the opening and closing of the control valves. In its simplest form, the described pump requires only three parts to be in contact with the pumped ingredients.

24 Claims, 7 Drawing Sheets

POSITIVE DISPLACEMENT DISPENSING PUMP SYSTEM

TECHNICAL FIELD

This invention relates generally to improved systems for pumping fluids and particularly to computer controlled positive displacement pumps utilized in dispensing food products of various viscosity.

BACKGROUND ART

Positive displacement pumps and motors using the principle of an angularly offset rotary axis to cause a piston or plunger to rotate and reciprocate simultaneously, are well known. Examples of such pumps include:

U.S. Pat. No. 1,312,962, issued to Dourte, which describes a Valveless Pump providing a double action; but the mechanism involves a crankshaft and bevel gear arrangement, in which an upper connecting rod is reciprocated by the crankshaft and rotated by the bevel gears.

U.S. Pat. No. 3,266,432, issued to Stewart W. Wortley on Aug. 16, 1966, describes a Pump having a single cylinder with a piston centrally located therein. A valve is positioned on each side of the piston, with each valve alternatingly covering and uncovering an intake and a discharge port. Reciprocation of the piston is accomplished by an angularly adjustable swash plate.

U.S. Pat. No. 4,941,809, issued to Pinkerton, describes Valveless Positive Displacement Metering Pump. The device is similar to those disclosed in the same patentee's earlier '872 and '003 patents, but includes an angularly adjustable table to adjust the angular offset between the drive motor and the pump cylinder and plunger.

U.S. Pat. No. 5,246,354, issued to Guillermo P. Pardinas on Sep. 21, 1993, describes a Valveless Metering Pump With Reciprocating, Rotating Piston. The cylinder includes a single inlet port and two outlet ports, with the three ports being radially spaced apart about the cylinder. The single plunger includes a single relief on one side, which alternately communicates with the ports. The advantage of the Pardinas device is that the timing between the relief and the ports may be adjusted to provide accurate metering of fluid from the pump.

In U.S. Pat. No. 3,807,909, St. Clair describes a Pump For Dispensing Food in which dispensing of liquid or semi-liquid food products is controlled by a spool type valve equipped with a discharge nozzle. The pump also includes a product metering cylinder into which product is drawn during an intake stroke of a piston and from which product is expelled during a discharge stroke of the piston. While development of such devices has continued, they nevertheless have various limitations relating to complexity, reliability, cost, and ease of manufacture, particularly in such devices to be used for food or medicinal dispensing.

Disclosure Of Invention

In the medical, food and other granular dispensing industries, there are needs for a computer controlled positive displacement dispensing pump, that can accurately control rate and volume portioning of the particulate articles being dispensed. The desired dispensing pump requires control of all aspects of pumping and dispensing, including: rate and volume of the recharge or intake stroke, and discharge cycle, timing, opening size and rate of the opening and closing of the control valves. This disclosure describes a pump that dispenses controlled amounts of material by controlling the pump's piston stroke and rate of travel by servomechanism means. In addition, a rotary servomechanism system is used to control the discharge and recharge cycles. Most positive displacement pumps driven by rotary motors have a fixed volume output per cycle. The positive displacement pump in this invention can accurately dispense or portion any amount up to the capacity of the pump.

It is also a requirement, particularly in the restaurant or fast food industry, that cleaning of the pump is to be as simple as possible and that individual country specifications, such as those of the National Sanitation Foundation in the U.S., are met. In its simplest form the described pump requires only three parts to be in contact with the pumped ingredients: the pump piston, the pump cylinder and the ingredient storage areas. The reduced number of parts in contact with the material being pumped is made possible by using a linear and rotary mechanism located remotely from the food contact area. There are also requirements that some material items to be dispensed must be held at a controlled environment. The remote mechanism, driving the piston through a shaft, makes it possible to keep the linear and rotary mechanism out of the environmentally controlled area.

With the servo control of the pistons displacement and the servo control of the pistons rotation, complete control of the timing of the dispense, the dispense amount, the rate of dispensing, dispense opening, dispense cut off, the timing of the intake cycle, the intake rate and intake volume are controllable and can be changed at any time.

Because the rotation of the piston controls port opening, the pump can selectively determine which port is the discharge port and which port is the intake port. The pump can also use the same port for both operations. In addition, by using a modified piston and cylinder, the pump can be programmed to selectively intake and discharge to a number of ports.

It is a principal object of this invention, therefore, to provide a computer controlled positive displacement pumping device which can accurately dispense controlled quantities of flowable product through preselected inlet and outlet ports.

It is an additional object of the invention to provide a pumping device having a piston which may be servo controlled in both positional displacement and rotational angles and velocities.

It is another object of the invention to provide a pumping device having a minimum number of parts in contact with a flowable food or medicinal product.

It is a further object of this invention to provide a dispensing pump which may be inexpensively manufactured, is structurally rigid and safe, and can be easily installed in existing food facilities.

These and other objects of the present invention will become readily apparent upon further review of the following specification and drawings.

The above and other objects, features and advantages of the present invention will become more apparent from the following description when making reference to the detailed description and to the accompanying sheets of drawings.

BEST MODE FOR CARRYING OUT THE INVENTION

Figure 1A:
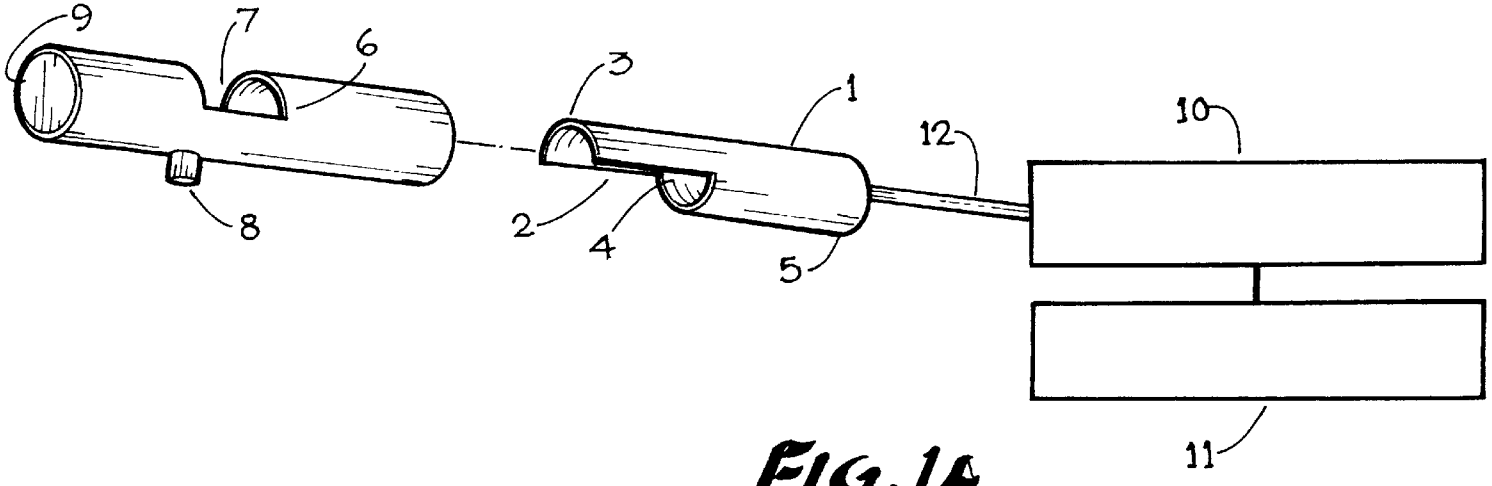
FIG. 1A is a perspective view of my rotating piston pump with the piston being exploded from a cylindrical structure having a large inlet port.
Figure 5:
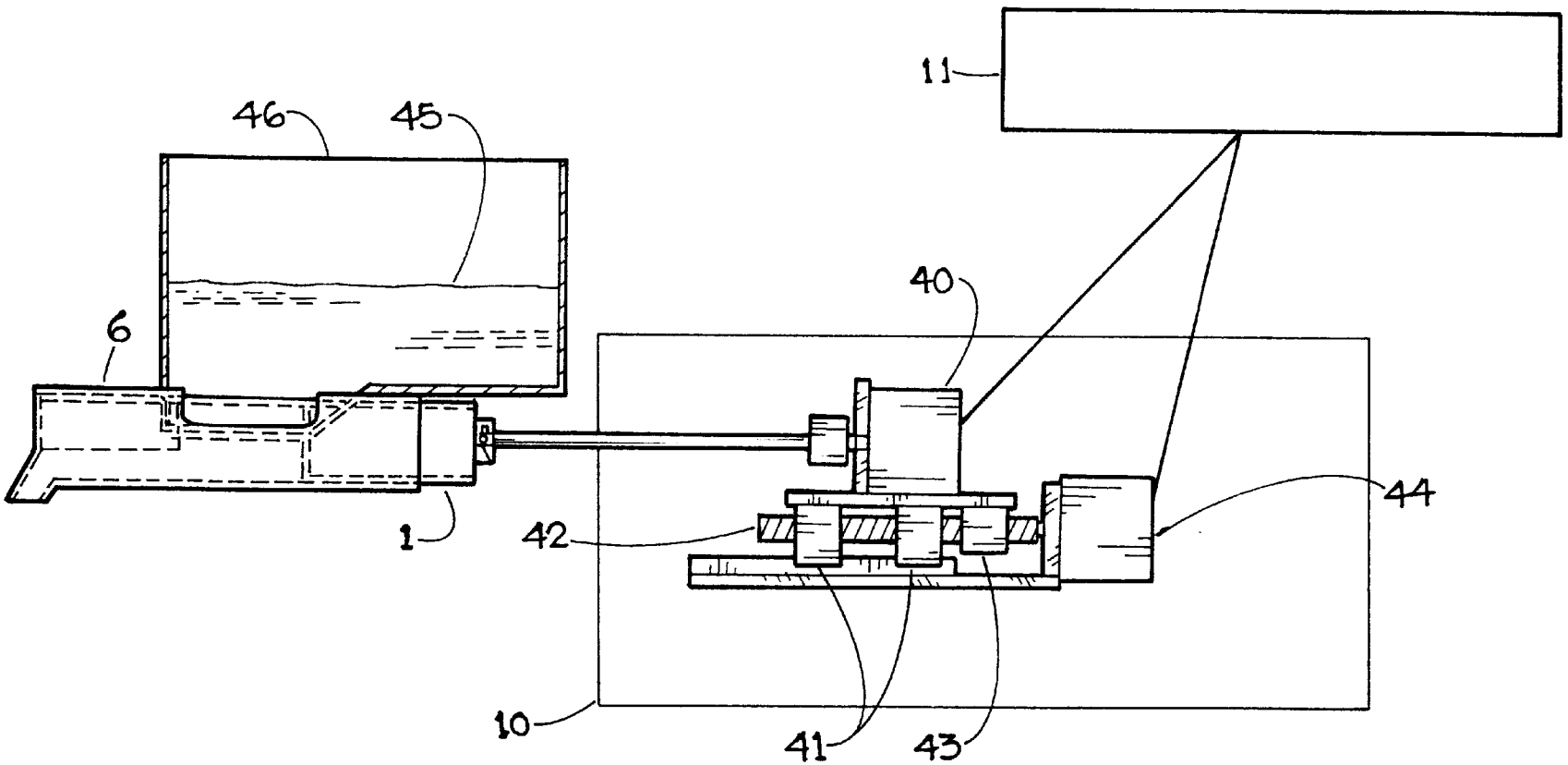
FIG. 5 shows a side view of the preferred embodiment of the complete pumping system.

FIG. 1A and FIG. 5 shows a perspective view of my rotating piston pump, with the piston 1 being exploded from piston housing means 6. Housing means 6 is closed at its first end by an end cap 9, and is open at its second opposite end. Inlet port means 7, and outlet port means 8 are connected to container means 46, holding the material being pumped 45, and are disposed upon the periphery of housing means 6 so that surface aperture means therein communicate with the interior of housing means 6.

Piston means 1 has a first hollow end portion 3, formed by removal of a segment of the piston surface at region 2, extending to a traverse wall 4. The second opposite end of piston means 1 comprises a full cylindrical section 5, separated from first hollow end portion 3 by the traverse wall 4. The piston is driven at the second end by piston connection means, such as piston rod 12, which in turn is coupled to linear and rotary drive means 10. The linear and rotary drive means 10 are controlled by motor controlling servo means 11, both shown in block diagram form. Servo control means include computer means, such as a microprocessor, to determine and execute desired positional and rotational command sequences.

In FIG. 1A, the pump is shown with a relatively large semicircular inlet port means 7, as would be used to fill the region 2 portion of the piston 1 when pumping solid or semi-liquid food products. When linearly inserted in housing 6 as shown, the outer surface of first hollow end portion 3 will act as a surface land means, and close the inlet aperture means. When rotated from the closed position, filling of the region 2 area will commence.

Figure 1B:
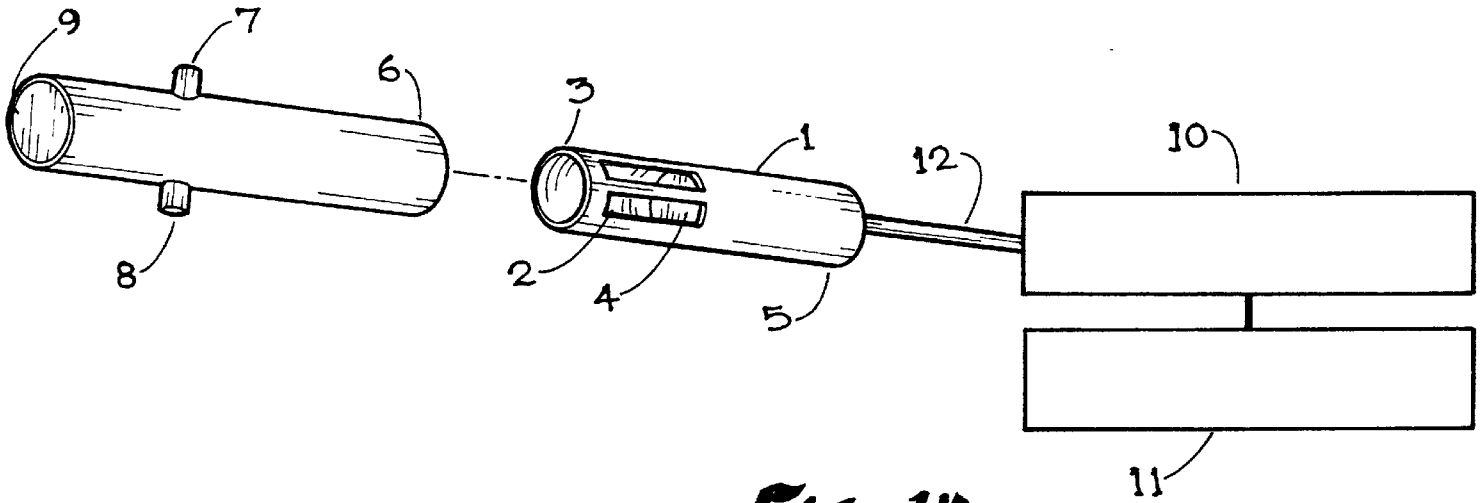
FIG. 1B is a perspective view of my rotating piston pump as shown in FIG. 1A, with the cylindrical structure having a smaller inlet port.

FIG. 1B shows the pump designed with the first hollow end portion 3 of piston 1 being cylindrical, with access to region 2 being provided by a plurality of peripheral slotted aperture means. These aperture means align with discharge port means 8, and the smaller inlet port means 7, such as would be used with lower viscosity fluids.

Figure 2A:
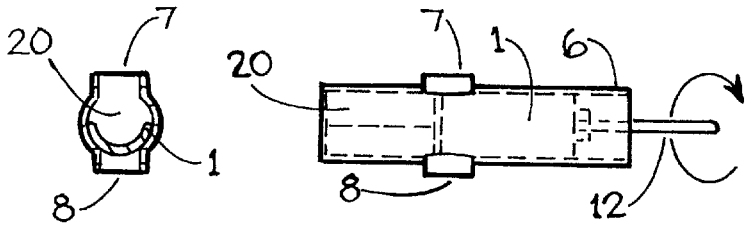
FIGS. 2A through 2G show side elevation and top plan views of a first embodiment of the assembled pump during an operational sequence.

FIGS. 2A through 2G show side elevation and top plan views of a first embodiment of the assembled pump during an operational sequence. These figures progress as follows:

In FIG. 2A, piston 1 is positioned in a cylindrical piston housing structure 6, and driven by linear and rotary drive means 10, (not shown) through shaft 12. The piston is rotated in the arrowhead direction and when the piston is drawn outward, inlet port means 7 is open.

Figure 2B:
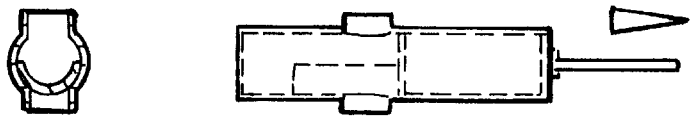

In FIG. 2B, the piston 1 is drawn further back, and material is drawn into the cavity 20, formed by the walls of the housing structure 6, and the region 2 portion of the piston 1.

Figure 2C:
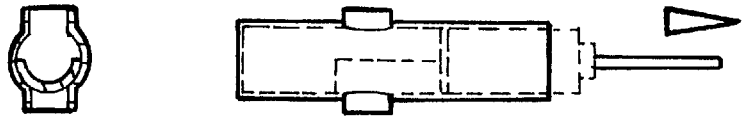

In FIG. 2C, at the maximum stroke, or at a lesser stroke as determined by controller means 11, the cavity 20 is completely filled.

Figure 2D:
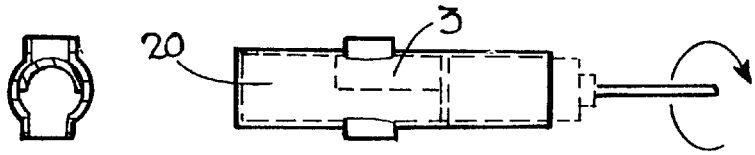

In FIG. 2D, the drive means rotates the piston so that the first hollow end portion 3 closes port means 7 to seal the cavity 20.

Figure 2E:
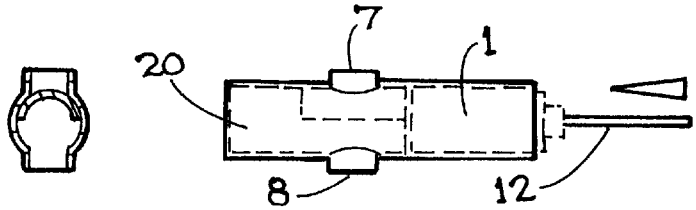

In FIG. 2E, the piston 1, on demand from the computer, moves at a specified speed and distance to reduce the size of cavity 20, thereby forcing the material which fills cavity 20 out of port means 8.

Figure 2F:
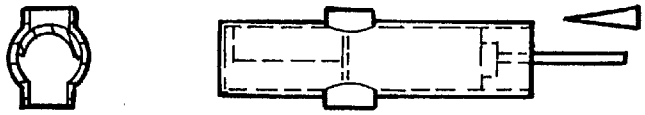

In FIG. 2F, at full stroke or less, depending on the displacement set by the computer, piston 1 stops.

Figure 2G:
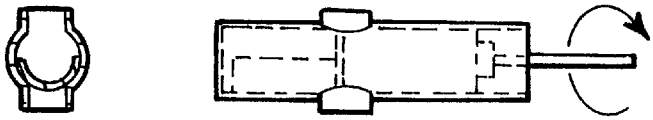

In FIG. 2G, piston 1 rotates such that the first hollow end portion 3 of piston 1 again closes port means 8.

Figure 3A:
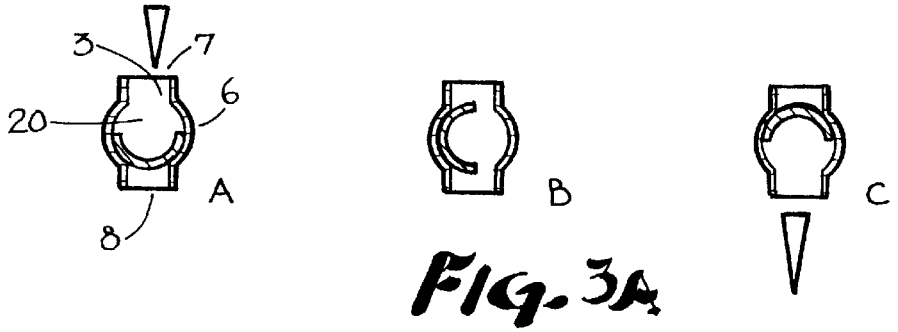
FIGS. 3A through 3D show side elevation views of the an operational sequence of the assembled pump with various piston embodiments.

FIGS. 3A through 3D show side elevation views of the assembled pump with various piston embodiments during an operational sequence. These figures progress as follows:

FIG. 3A shows end sequential views of the pump using the piston embodiment of FIG. 2. The operational steps are:

FIG. 3A (A)—first tubular end portion 3 of piston 1 closes outlet port 8. As piston 1 retracts, the cavity 20 is filled from port 7.

FIG. 3A (B)—end portion 3 of piston 1 is rotated midway.

FIG. 3A (C)—end portion 3 of piston 1 closes port 7. As the piston pushes the material in cavity 20, it is discharged through port 8.

Figure 3B:
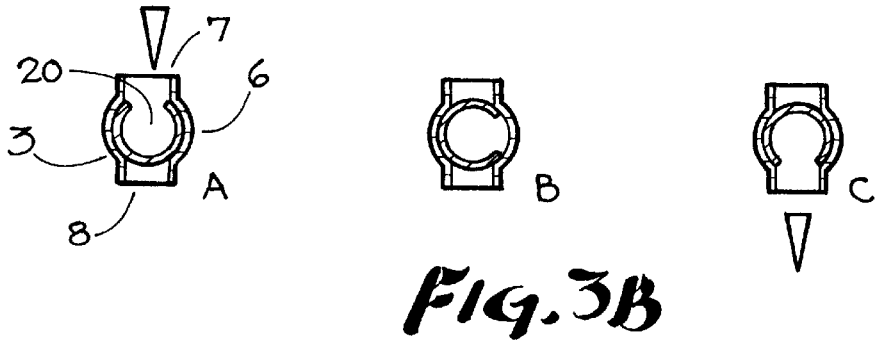

FIG. 3B shows end sequential views of the pump using a piston embodiment designed to close port 7 before opening port 8. The operational steps are:

FIG. 3B (A)—end portion 3 of piston 1 is closing port 8 as the cavity 20 is filled from port 7.

FIG. 3B (B)—end portion 3 of piston 1 is being rotated and shown midway. Both ports are closed. This configuration makes it possible to self prime the pump.

FIG. 3B(C)—end portion 3 of piston 1 is opening port 8. As piston 1 pushes the material in cavity 20, the material is discharged through port 8.

Figure 3C:
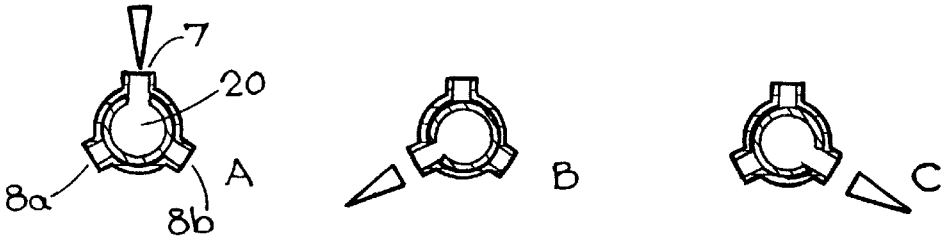

FIG. 3C shows end sequential views of the pump using a piston embodiment designed to selectively pump and discharge to designated ports. The operational steps are:

FIG. 3C (A)—As piston 1 is retracted, the cavity 20, is filled with material from port 7.

FIG. 3C (B)—With piston 1 in the position shown, pushing piston 1 discharges cavity 20 through port 8*a*.

FIG. 3C (C)—Alternately, with piston 1 in the position shown, pushing the piston discharges cavity 20 through port 8*b*.

Figure 3D:
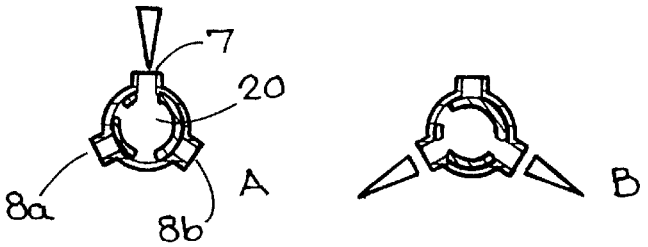

FIG. 3D shows end sequential views of the pump using a piston embodiment arranged to pump from one port and discharge to two or more ports.

FIG. 3D (A)—As piston 1 is retracted, the cavity 20, is filled with material from port 7.

FIG. 3D (B)—With piston 1 in the position shown, pushing piston 1 discharges the cavity 20 through both ports 8*a* and 8*b*.

Figures 4A, 4B, 4C, 4D, 4E:
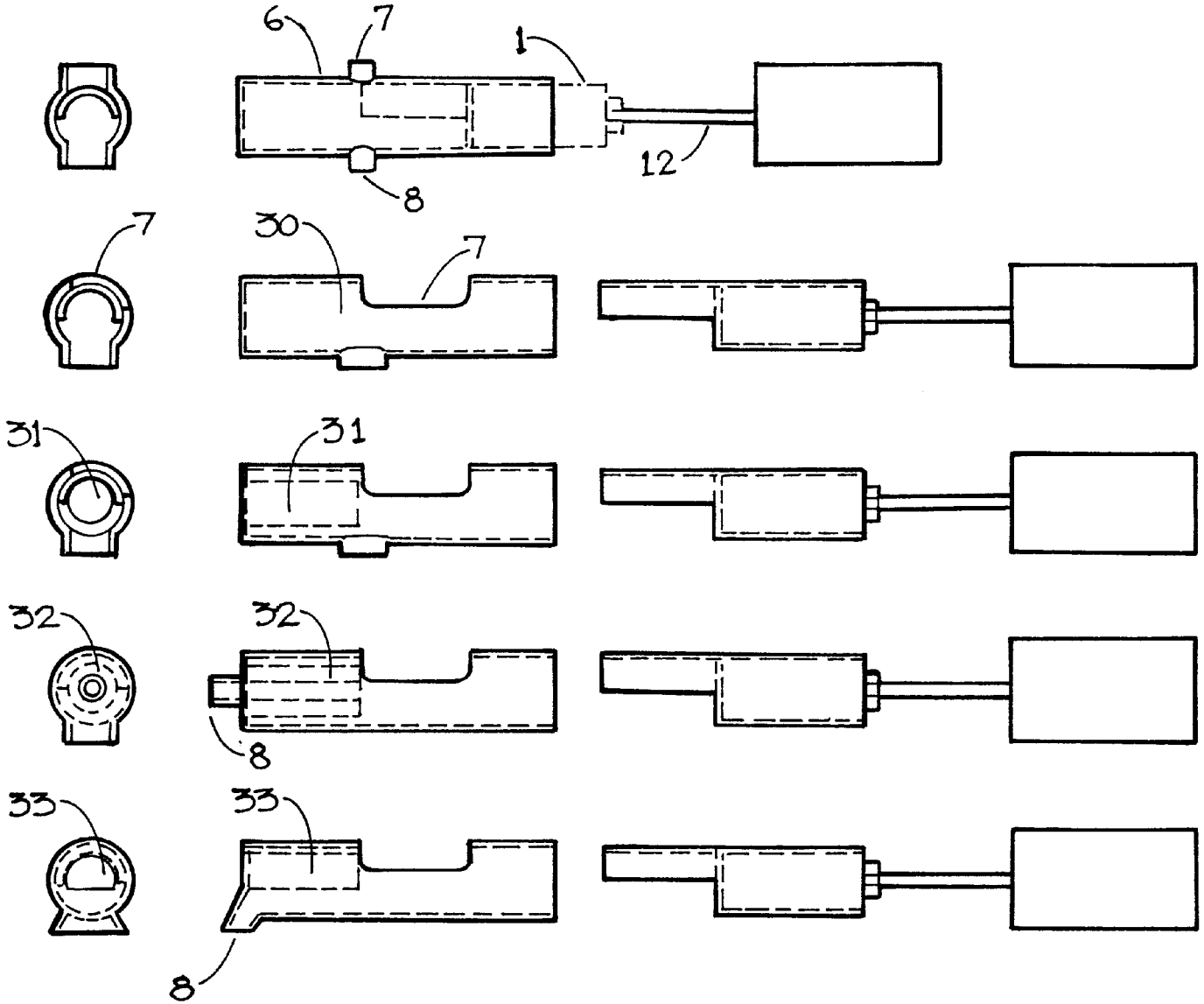
FIGS. 4A through 4E show side elevation and top plan views of alternate embodiments to meet special applications

FIGS. 4A through 4E show side elevation and top plan views of alternate embodiments which utilize modifications to the pump housing or piston in order to meet special applications. These include:

FIG. 4A, shows the basic pump housing structure 6, and piston 1.

FIG. 4B shows a similar pump with an enlarged inlet port 30.

This has applications for gravity feed applications for quickly dispensing thick flowable materials, such as meat and beans.

FIG. 4C shows a pump similar to FIG. 4B, with a plug 31 filling cavity 20. This reduces the volume of material being left in the pump.

FIG. 4D shows a pump similar to FIG. 4C, which has a hole in plug 32, which permits the material to be discharged from the end of the housing. In this case, the end portion 3, of piston 1, does not cut off port 8.

FIG. 4E shows a pump similar to FIG. 4D, wherein the plug 33 is repositioned in order to pump the material to be pumped from the end of the housing in a downward direction.

FIG. 5 shows a pumping system arranged as a complete embodiment, including the pump as shown in FIG. 4E; container means 46 is attached and sealed to housing 6, which holds flowable material 45; and a linear and rotary mechanism 10 to drive and control the piston. The preferred embodiment of mechanism 10, consists of a separately controlled rotary motor 40, mounted on a linear motion drive system, and including linear guides 41, ball screw or acme lead screw 42, ball or acme nut 43 and servo motor 44. Both linear and rotary motors are controlled by motor control circuitry within servomechanisms in response to commands from computer 11. Under such command, the position, velocity, and acceleration of the piston may be controlled. Any portion size can be programmed into the computer, the maximum size being determined by the volume of the cylindrical section 3, of piston 1, and housing 6. Since this pump has a large inlet port, a fast intake or recharge of the pump will occur.

Figure 6:
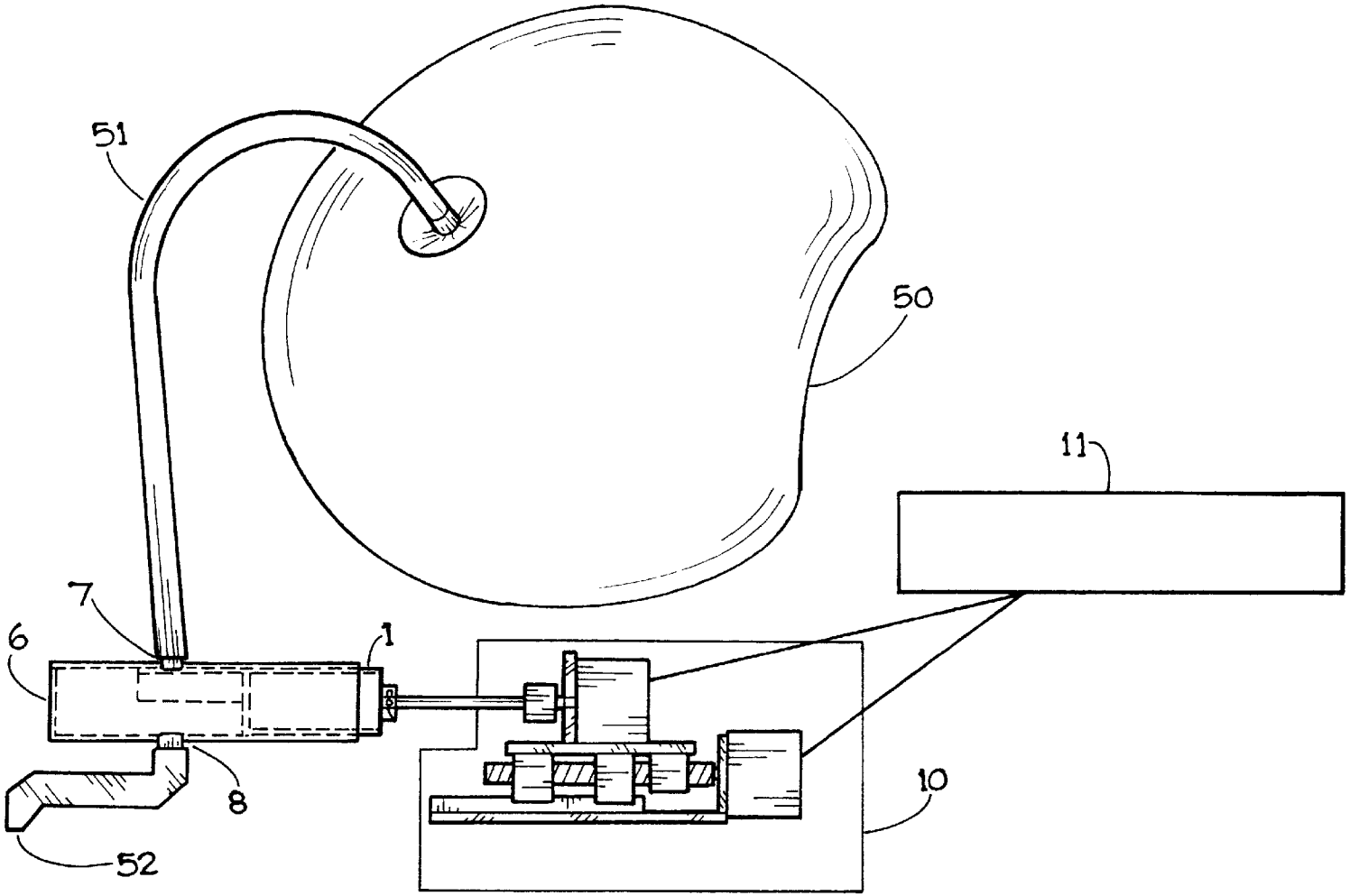
FIG. 6 shows another side view of the preferred embodiment pumping material from a flexible bag product container.

FIG. 6 shows another application of the rotating piston pump. This pump, using the configuration of FIG. 4A, is used for pumping material from a flexible bag 50, through a hose 51, to the inlet port 7. The bag, of course, will be supported by separate container means, not shown, and may be pressurized by various known means. The discharge from port 8, is directed to an offset dispensing nozzle 52.

Figure 7:
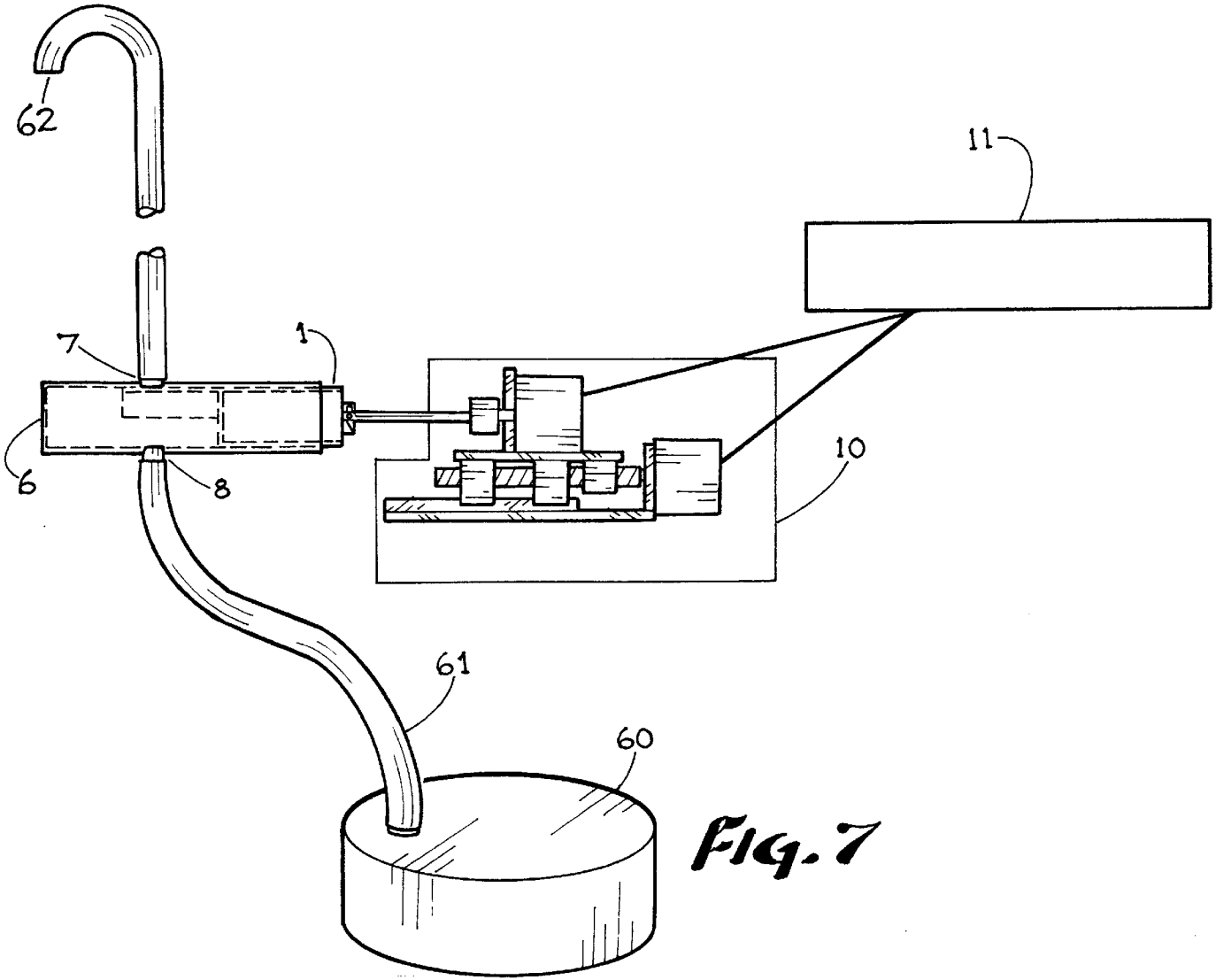
FIG. 7 shows a side view of an arrangement used for pumping material upward from a container through reversed inlet and outlet ports.

FIG. 7 shows a configuration similar to FIG. 6, which illustrates interchangeableness of the port means. As shown, the system is used for pumping material upward from a container 60, through hose or pipe 61, to a remote dispenser 62 connected to port 7.

In all of the above configurations, a close fit is assumed between the piston and cylinder, and separate sealing means are not shown. Where such fits are not feasible, separate conventional piston ring seals may be used.

The flexibility of this pumping system is such that any of the piston or housing configurations shown in the previous figures, may be modified for special use on many applications. In the preferred embodiments above, servo control of the piston's linear and rotational position may be flexibly obtained. In addition, the relative relationship between rotational and linear displacement is changeable to adapt to various port configurations.

The servo systems may use electric, hydraulic, or pneumatic power mediums, which may be located in a controlled environment separate from the food materials being dispensed.

Industrial Applicability

The restaurant and consumer products industries are making increased use of flexible bags to contain food and other products. These bags are easy to handle and require less storage and shipping space. Current semi-automation is achieved by transferring ingredients into mechanical handheld dispensing devices or through the use of enfitments. The enfitments are attached to the bag and used to interface with a dispense hose or nozzle. These enfitments are either placed on the bag before loading or attached at location of use. Both means increase the material cost and require additional labor to attach the enfitments or fill the mechanical handheld device. Additionally, the excessive product handling necessary to dispense the ingredients causes undesirable waste and food handling risks.

Dispensers are also required to hold and dispense materials over a wide range of temperatures, and must provide maximum safety in dispensing and storage of products, such as food, in their original container. In the United States, for example, all dispensing apparatus used must be approved by the Federal Drug administration (F.D.A.), by the National Sanitation Foundation (N.S.F.) and by local safety authorities. In order to meet such requirements, equipments used must be easily cleaned, made from material that does not support bacterial growth, have minimum bend radii, and eliminate cracks which can hide food particles. Since the invention described herein will safely provide automatic dispensing of uniform dosages of flowable materials, it will have immediate utility in all food handling industries.

The foregoing description and drawings were given for illustrative purposes only, it being understood that the invention is not limited to the embodiments disclosed, but is intended to embrace any and all equivalents alternatives, modifications and rearrangements of elements falling within the scope of the invention as defined by the following claims.

What I claim is:

1. An apparatus for pumping controlled quantities of flowable product, comprising:

container means to hold a supply of flowable product material to be dispensed therefrom;

piston housing means having one or more inlet port means adapted to receive a supply of said flowable product material from said container means, and one or more outlet port means adapted to dispense said product from said piston housing means;

piston means supported within said piston housing means, said piston means having a first hollow end portion with surface aperture means and surface land means thereon to permit or restrict flow of said flowable product material into and out of the interior of said first hollow end portion, and having a second opposite end portion separated from said first hollow end portion by a traverse wall therein;

piston drive means are connected to said second opposite end portion of said piston means to impart linear and rotary motion to said piston means, said piston drive means being supported by said piston housing means;

rotary drive means connected to said piston drive means and adapted to alternately cause said surface aperture means on said first hollow end portion of said piston means to align with a portion of one or more said inlet port means to permit product flow, while causing said surface land means to restrict product flow from a portion of said plurality of outlet port means, then cyclically reversing said process to inhibit input product flow and permit dispensing of said flowable product material through said outlet port means;

linear drive means connected to said piston drive means and adapted to alternately stroke said piston means to cyclically draw said flowable product material from said container means through said inlet port means into the interior of said first hollow end portion of said piston means, and to cyclically pump said flowable product material from the interior of said first hollow end portion of said piston means out through said outlet port means;

first servo control means operatively connected with said rotary drive means to separately control the angle of said piston drive means in response to rotational commands;

second servo control means operatively connected with said linear drive means to separately control the linear position of said piston means in response to a displacement command; and computer means connected to operate said first and second servo control means, said computer means being programmed to determine positional and rotational command sequences for independent execution by said first and second servo control means.

2. The apparatus in accordance with claim 1, wherein said computer means is programmed to selectively enable all said inlet port means to be closed before opening any said outlet port means whereby the pump is self-primed.

3. The apparatus in accordance with claim 2, wherein said inlet port means are disposed to obtain gravity flow assistance in flowing product material from said container means to said inlet port means.

4. The apparatus in accordance with claim 3, wherein said outlet port means are disposed to permit selection of an output dispensing angle.

5. The apparatus in accordance with claim 4, wherein said computer means is programmed to selectively reverse said inlet and outlet discharge port means.

6. The apparatus in accordance with claim 5, wherein said computer means is programmed to use the same port means for both input and output operations means.

7. The apparatus in accordance with claim 6, wherein said computer means is programmed to selectively enable one or more port means to refill and discharge a flowable material by selectively opening and closing the port means.

8. The apparatus in accordance with claim 7, wherein said rotary drive means is disposed on said linear drive means.

9. The apparatus in accordance with claim 8, wherein said linear drive means comprises a rotary drive means and a rotary-to-linear motion converter.

10. The apparatus in accordance with claim 9, wherein said rotary-to-linear motion converter comprises a lead screw mechanism.

11. The apparatus in accordance with claim 10, wherein said flowable product is a food product.

12. The apparatus in accordance with claim 7, wherein said product is a medicinal.

13. A method of pumping controlled quantities of flowable product, comprising the steps of:

holding a supply of flowable product material in container means for dispensing therefrom;

providing cylindrical piston housing means having one or more inlet porting means adapted to receive a supply of said flowable product material from said container means, and one or more outlet porting means adapted to dispense said product from said piston housing means;

assembling piston means within said piston housing means, said piston means having a first tubular end portion with surface apertures and surface lands thereon to permit or restrict flow of said flowable product material into and out of the interior of said first tubular end portion, and having a second opposite end portion separated from said first tubular end portion by a traverse wall therein;

joining piston drive means connected to said second opposite end portion of said piston means to impart linear and rotary motion to said piston means, said piston drive means being supported by said piston housing means;

attaching rotary drive means connected to said piston drive means, said rotary drive means being adapted to alternately cause said surface apertures on said first tubular end portion of said piston means to communicate with a portion of said one or more inlet porting means while causing said surface lands to restrict communication from a portion of said one or more outlet porting means, then cyclically reversing said process to inhibit input communication and permit dispensing of said flowable product material through said outlet ports;

connecting linear drive means to said piston means, said linear drive means being adapted to alternately stroke said piston means to cyclically draw said flowable product material from said container means through said inlet ports into the interior of said first tubular end portion of said piston means, and to force said flowable product material from the interior of said first tubular end portion of said piston means out through said outlet ports;

providing first servo control means operatively connected with said rotary drive means to angularly position said piston rod means in response to rotational commands;

providing second servo control means operatively connected with said linear drive means to linearly position said piston rod means in response to a displacement command; and connecting computer means to operate said first and second servo control means, said computer means being programmed to determine positional and rotational command sequences for independent execution by said first and second servo control means.

14. A method of pumping controlled quantities of flowable product, as recited in claim 13, wherein said means is programmed to selectively enable closure of all said inlet port means before opening any said outlet port means, whereby the pump is self-primed.

15. A method of pumping controlled quantities of flowable product, as recited in claim 14, wherein said inlet ports are disposed to permit gravity flow of product material from said container means to said inlet porting means.

16. A method of pumping controlled quantities of flowable product, as recited in claim 15, wherein said outlet ports are disposed to permit selection of an output dispensing angle.

17. A method of pumping controlled quantities of flowable product, as recited in claim 16, wherein said computing means is programmed to selectively change inlet and outlet discharge port means.

18. A method of pumping controlled quantities of flowable product, as recited in claim 17, wherein said computer means is programmed to use the same port means for both input and output operations.

19. A method of pumping controlled quantities of flowable product, as recited in claim 18, wherein said computer means is programmed to selectively recharge and discharge a plurality of port means.

20. A method of pumping controlled quantities of flowable product, as recited in claim 19, wherein said rotary drive means is disposed on said linear drive means.

21. A method of pumping controlled quantities of flowable product, as recited in claim 20, wherein said linear drive means comprises a rotary drive means and a rotary-to-linear motion converter.

22. A method of pumping controlled quantities of flowable product, as recited in claim 21, wherein said rotary-to-linear motion converter comprises a lead screw mechanism.

23. A method of pumping controlled quantities of flowable product, as recited in claim 22, wherein said flowable product is a food product.

24. A method of pumping controlled quantities of flowable product, as recited in claim 19, wherein said flowable product is a medicinal.

* * * * *